US010581148B2

(12) United States Patent
Jeong et al.

(10) Patent No.: US 10,581,148 B2
(45) Date of Patent: Mar. 3, 2020

(54) EXTERNAL ANTENNA FOR VEHICLE

(71) Applicant: Molex, LLC, Lisle, IL (US)

(72) Inventors: Dae Hyeon Jeong, Suwon (KR); Chang Heon Oh, Suwon (KR); Hu Bong Jeong, Suwon (KR); Ju Bong Yoo, Suwon (KR)

(73) Assignee: Molex, LLC, Lisle, IL (US)

( * ) Notice: Subject to any disclaimer, the term of this patent is extended or adjusted under 35 U.S.C. 154(b) by 82 days.

(21) Appl. No.: 15/753,568

(22) PCT Filed: Aug. 18, 2016

(86) PCT No.: PCT/US2016/047479

§ 371 (c)(1),
(2) Date: Feb. 20, 2018

(87) PCT Pub. No.: WO2017/031272

PCT Pub. Date: Feb. 23, 2017

(65) Prior Publication Data

US 2018/0241118 A1 Aug. 23, 2018

(30) Foreign Application Priority Data

Aug. 20, 2015 (KR) ..... 10-2015-0117469

(51) Int. Cl.
*H01Q 1/32* (2006.01)
*H01Q 1/38* (2006.01)
(Continued)

(52) U.S. Cl.
CPC ..... *H01Q 1/38* (2013.01); *H01Q 1/1214* (2013.01); *H01Q 1/3275* (2013.01);
(Continued)

(58) Field of Classification Search
CPC ..... H01Q 1/38; H01Q 21/28; H01Q 1/1214; H01Q 1/3275; H01Q 9/0407
See application file for complete search history.

(56) References Cited

U.S. PATENT DOCUMENTS

2015/0130679 A1 5/2015 Shin et al.
2015/0236404 A1* 8/2015 Choi ..... H01Q 1/36 343/722
2016/0104932 A1* 4/2016 Aminzadeh ..... H01Q 1/3275 343/872

FOREIGN PATENT DOCUMENTS

KR 10-0843150 B1 7/2008
KR 10-0980774 B1 9/2010
KR 2011-0066639 A 6/2011

* cited by examiner

*Primary Examiner* — Dieu Hien T Duong
(74) *Attorney, Agent, or Firm* — Molex, LLC

(57) ABSTRACT

An antenna is disclosed wherein a plurality of antennas are combined in a single housing, whereby antenna radiation performance can be improved by increasing frequency bandwidth while minimizing signal interference between antennas. The antenna has a case, a housing, a circuit board, and a base. The case has an open bottom. The housing, formed in a shape corresponding to the interior surface of the case and inserted into the interior of the case, has a plurality of radiating bodies that send and receive signals in a plurality of frequency bands, and a coupling patch that increases frequency bandwidth and minimizes signal interference between radiating bodies. The board is mounted in the case and whereon a feeding pad is furnished that is electrically connected to the radiating bodies. The base is mounted on the board so as to couple to the case and block to open bottom of the case.

6 Claims, 11 Drawing Sheets

(51) Int. Cl.

| | |
|---|---|
| ***H01Q 1/12*** | (2006.01) |
| ***H01Q 9/04*** | (2006.01) |
| ***H01Q 21/28*** | (2006.01) |
| *H01Q 1/36* | (2006.01) |

(52) U.S. Cl.
CPC ..... *H01Q 9/0407* (2013.01); *H01Q 21/28* (2013.01); *H01Q 1/36* (2013.01)

EXTERNAL ANTENNA FOR VEHICLE

RELATED APPLICATIONS

This application claims priority to PCT Application No. PCT/US2016/047479, filed Aug. 18, 2016, which in turn claims priority to Korean Application No. 10-2015-0117469, filed Aug. 20, 2015, which is incorporated herein by reference in its entirety.

TECHNICAL FIELD

This disclosure relates to an antenna for use in a vehicle, and more specifically to an external antenna for a vehicle that is mounted on the exterior of the vehicle and receives or transmits radio waves.

BACKGROUND ART

With the development of wireless communications, various kinds of communication devices have been installed in vehicles, including radios, navigation, DMB, etc.; and for these devices, antennas also have to be mounted.

As numerous antennas have thus come to be installed on the inside and outside of vehicles, because of the vehicle's shielding effect tending to reduce the reception rate for internal antennas, antennas have been mounted on the outside of the vehicle, and external antennas in the shape of a shark fin, which is an attractive shape with low air resistance, have attracted growing attention.

Generally, shark-fin antennas consist of ceramic-chip-type GPS antennas, fixed to a base, and AM/FM/DMB antennas in a coil or PCB shape.

However, with the recent growth in multimedia, as demand has arisen for "infotainment" services in which information can be gathered while in the vehicle, a need has arisen for a plurality of antennas that can support such services, such as GSM, LTE, WiFi, AM, and FM antennas.

Apart from AM/FM and WiFi antennas, LTE antennas in particular require at the same time both a main antenna and a diversity antenna, and only when the interference between these two antennas is minimized is the data transmission speed good and data distortion reduced.

However, previously, when the two kinds of LTE antennas (main, diversity) have been added in the narrow interior of the sharkfin antenna, especially in the low frequency band (700 MHz-1 GHz), signal interference has been severe, leading to data distortion and impaired data transmission speed.

In addition, the problem has arisen of the limitations on the size to which the sharkfin antenna mounted on the exterior of a vehicle can grow, in view of the need to keep all of the antennas covering a plurality of frequency bands within a single sharkfin antenna.

In addition, as electric power has been supplied by soldering the antenna contacts to a circuit board, there has been the problem of power supply and inadequate electrical contact at the solder sites due to external impact.

Patent Reference: Republic of Korea Registered Patent Gazette No. 10-0843150 (issued 2008 Jul. 2)

SUMMARY

The technical problem this disclosure attempts to solve is the provision of an external antenna for vehicle use that can improve the radiative performance of the antennas by increasing frequency bandwidth and minimizing signal interference between antennas.

Another technical problem this disclosure attempts to solve is the provision of an external antenna for vehicle use that can simplify processes and design, and reduce manufacturing costs, by arranging a plurality of antennas in a single housing.

A further technical problem this disclosure attempts to solve is the provision of an external antenna for vehicle use that has an improved electrical-feeding structure between the antenna and circuit board.

To achieve the technical objectives, according to a preferred embodiment of this disclosure, the external antenna for vehicle use according to this disclosure may comprise: a case open at the bottom; a housing inserted within the case and formed in a shape corresponding to the interior surface of the case, and furnished with a plurality of radiating bodies that send and receive signals in a plurality of frequency bands, as well as coupling patches that increase the frequency bandwidth while reducing signal interference among the radiating bodies; a circuit board mounted in the case and furnished with feeding pads that transmit electricity to the radiating bodies; and a base, whereon the circuit board is mounted, that couples to the case and blocks the open bottom of the case.

In addition, the radiating bodies may comprise: a first radiating body that is formed as a pattern on one side of the housing and realizes a main band in the LTE frequency band; and a second radiating body that is formed as a pattern on the other side of the housing opposite the side on which the first radiating body is formed, and which realizes a diversity band in the LTE frequency band.

In addition, the first radiating body and the second radiating body may comprise a frequency high band and a low band; and the low band may be formed so as to adjoin the coupling patch.

In addition, the coupling patches may be formed on the inner surface and outer surface of the housing between the first radiating body and the second radiating body.

In addition, the coupling patches may be formed so as to connect to at least one of the plurality of radiating bodies formed as a pattern on the housing.

The external antenna for vehicle use according to a preferred embodiment of this disclosure, in order to achieve the technical task, may comprise: a case open at the bottom; a housing inserted within the case and formed in a shape corresponding to the interior surface of the case, and furnished with a plurality of radiating bodies that send and receive signals in a plurality of frequency bands; a circuit board mounted in the case and furnished with feeding pads that transmit electricity to the radiating bodies; and a base, whereon the circuit board is mounted, that couples to the case and blocks the open bottom of the case; wherein the radiating bodies comprise: a first radiating body that is formed as a pattern on one side of the housing and realizes a main band in the LTE frequency band; and a second radiating body that is formed as a pattern on the other side of the housing opposite the side on which the first radiating body is formed, and which realizes a diversity band in the LTE frequency range.

In addition, a contact part may be furnished on the bottom of the housing, connected to the radiating bodies, and also a conductive elastic part may be furnished on the top of the circuit board, connected to the feeding pads; and the radiating bodies may be electrically connected to the feeding pads by contact of the contact part with the elastic part.

In addition, the elastic part may consist of a conductive foam or coil.

In addition, a projecting part may be formed on the bottom of the housing so as to fit into a recessed part on the circuit board, and a hook part may be formed on the bottom of either side of the housing so as to catch onto either edge of the circuit board; and the housing may be fixed to the circuit board by the projecting part and the hook part.

To achieve the technical objectives, according to a preferred embodiment of this disclosure, the external antenna for vehicle use according to this disclosure may comprise: a case open at the bottom; a housing inserted within the case and formed in a shape corresponding to the interior surface of the case, and furnished with a plurality of radiating bodies that send and receive signals in a plurality of frequency bands; a circuit board mounted in the case and furnished with feeding pads that transmit electricity to the radiating bodies; and a base, whereon the circuit board is mounted, that couples to the case and blocks the open bottom of the case; wherein a contact part is furnished on the bottom of the housing, connected to the radiating bodies, and also furnished with a conductive elastic part on the top of the circuit board, connected to the feeding pads; and wherein the radiating bodies are electrically connected to the feeding pads by mutual contact of the contact part with the elastic part.

Because the external antenna for vehicle use of this disclosure uses a coupling patch to find an optimal location for mutual interference between the antennas for a plurality of frequency bands, it enables improvement in transmission speed without data distortion by minimizing signal interference between the antennas covering a plurality of frequency bands within a narrow space, particularly the LTE main antenna and the diversity antenna; and also enables maximizing the antenna radiation efficiency and increasing the antenna frequency bandwidth.

In addition, because this disclosure realizes radiating bodies for a plurality of frequency bands within a single housing, the difficulty of having to design the antenna radiating bodies separately and assemble them within a respective shark fin may be reduced, and fabrication costs may be reduced by improving the inefficiencies in the use of space that arise when each antenna is mounted separately; and an overall reduction in cost can be achieved due to the simplification of the assembly process.

In addition, this disclosure has the effect of enabling a power supply that is resilient against physical impacts, because the radiating bodies for a plurality of frequency bands are elastically connected to the feeding pads by means of a conductive foam or conductive coil.

DETAILED DESCRIPTION OF THE PREFERRED EMBODIMENTS

Hereinbelow, preferred embodiments of this disclosure will be explained in detail with reference to the attached diagrams. Please note that in describing this disclosure, the detailed explanation is omitted of functions and components which are common knowledge and are judged to unnecessarily obscure the core intent of the disclosure.

Figure 1:
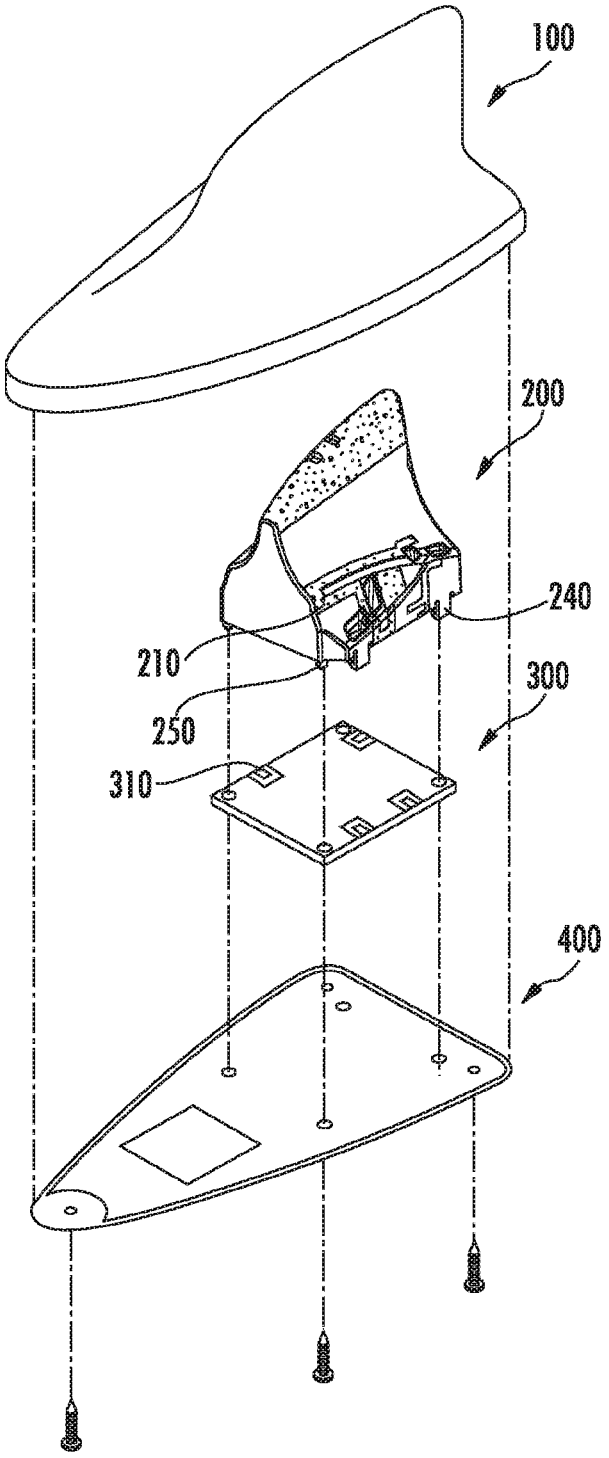
FIG. 1 is an exploded perspective view of the external antenna for vehicle use according to a preferred embodiment of this disclosure.

FIG. 1 is an exploded perspective view of the external antenna for vehicle use according to a preferred embodiment of this disclosure.

As shown in FIG. 1, the external antenna for vehicle use according to a preferred embodiment of this disclosure may comprise a case 100, housing 200, circuit board 300, and base 400.

The case 100 is formed in a triangular shape that tapers toward the top, e.g. in the shape of a shark fin, and is open at the bottom. The case 100 may be formed in various shapes in addition to a shark-fin shape.

The housing 200 is inserted via the open bottom of the case 100. The housing 200 is formed in a shape corresponding to the internal surface of the case 100. For example, although the housing 200 may be formed identically to the case 100 in the shape of shark fin, it is not limited thereto but may have diverse other shapes.

Specifically, the external antenna for vehicle use according to this embodiment is formed in the shape of a shark fin, and the shape of the housing 200 according to this embodiment may also be designed in a shark fin shape. This may be realized in diverse shapes with respect to the antenna radiating body design described hereinbelow, compared to such antennas of the prior art as helical-type or PCB-type antennas; and because the radiating bodies can be designed to be as far as possible from the circuit board, optimal antenna performance can be assured.

In the housing 200 may be furnished a plurality of antenna radiating bodies 210 that transmit and receive RF signals in a plurality of frequency bands, such as GPS, GSM, CDMA, LTE, BT/WiFi, AM/FM, etc. In addition, there may be furnished in the housing 200 a coupling patch 220 that increases the width of the frequency bands while minimizing signal interference between the radiating bodies.

A circuit board 300 is mounted inside the case 100, and is furnished with a feeding pad 310 that is electrically connected to the radiating bodies 210.

The base 400 is mounted on the top of the circuit board 300, and coupled to the case 100 so as to block the open bottom of the case 100. The base 400 is affixed to the roof of the vehicle.

Figure 2:
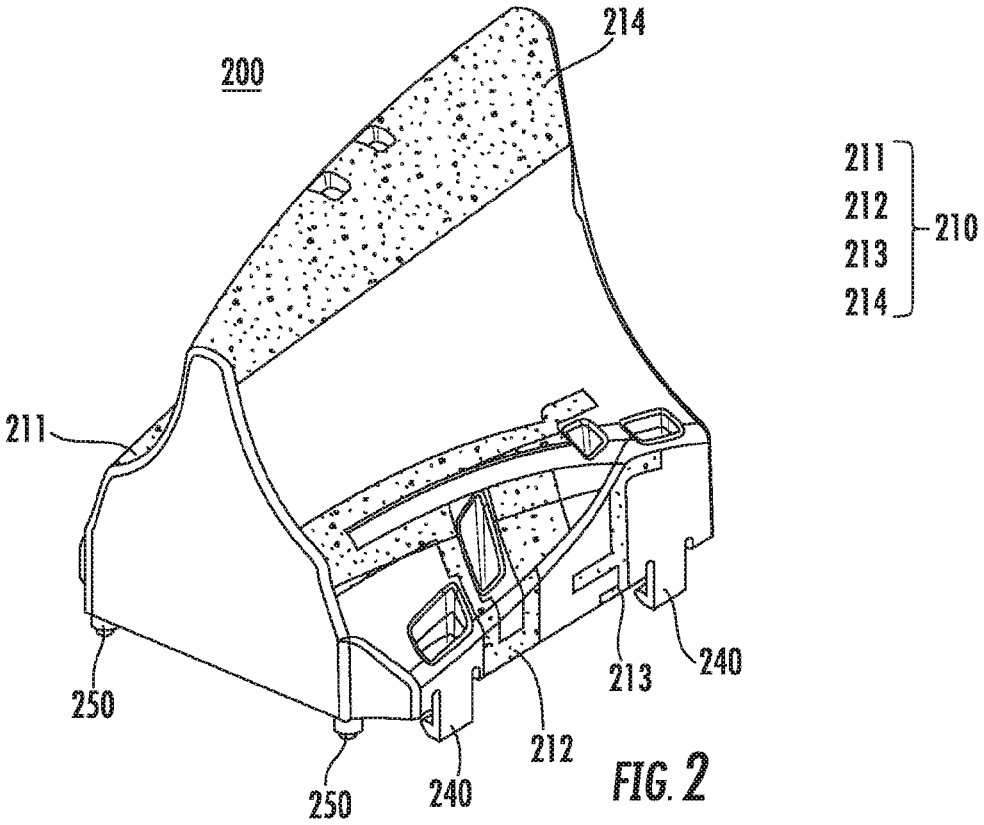
FIG. 2 is a perspective view depicting an embodiment of the housing of the external antenna for vehicle use.
Figure 3:
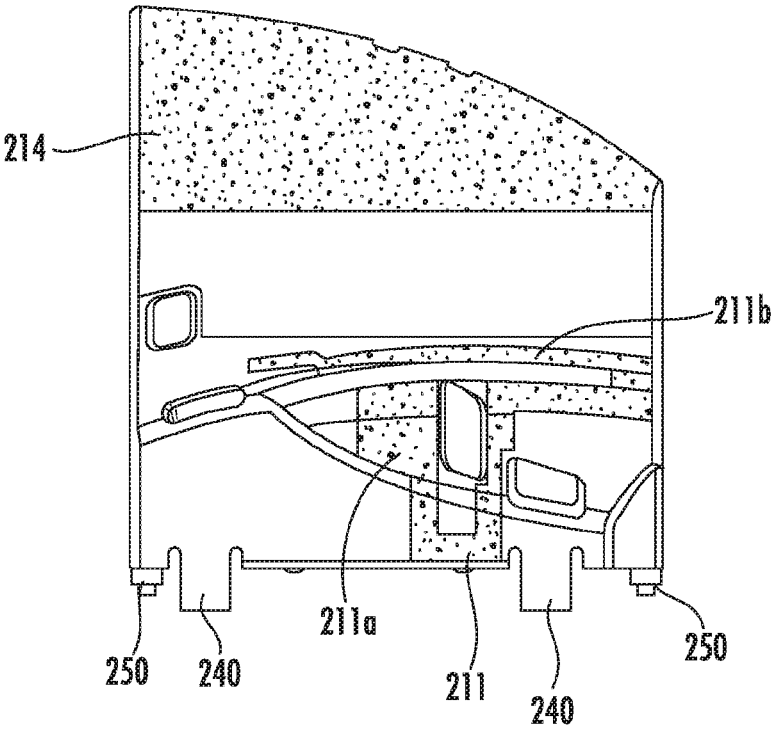
FIG. 3 is a left-side view of FIG. 2.
Figure 4:
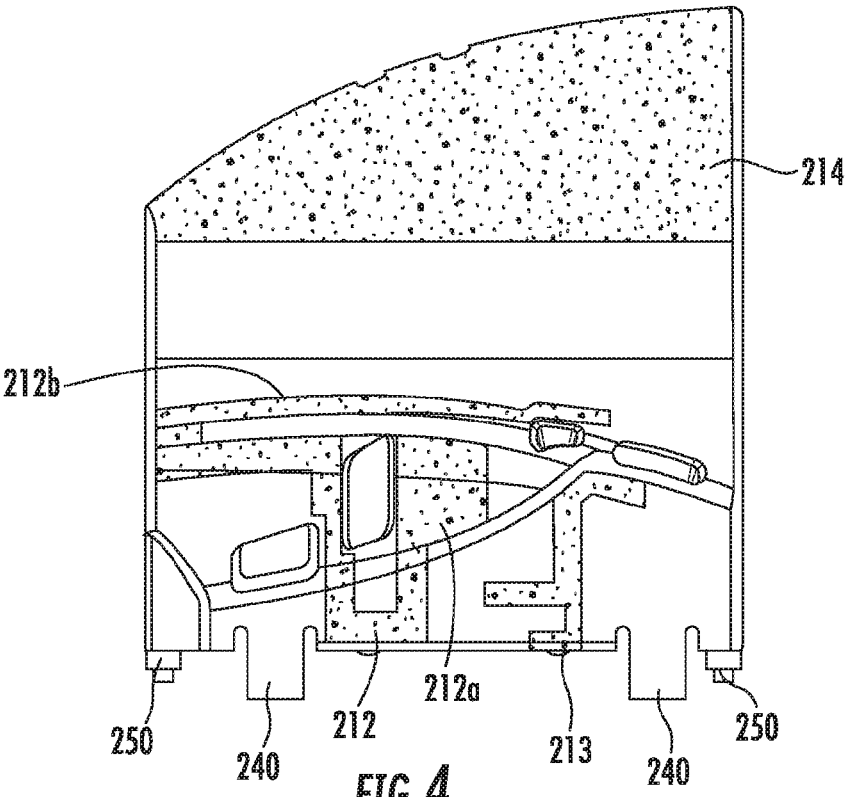
FIG. 4 is a right-side view of FIG. 2.
Figure 5:
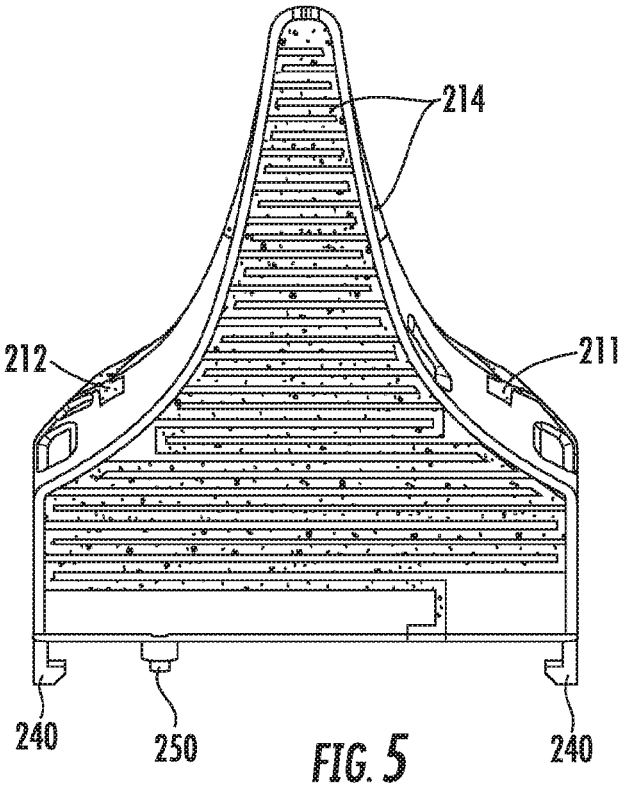
FIG. 5 is a rear view of FIG. 2.
Figure 6:
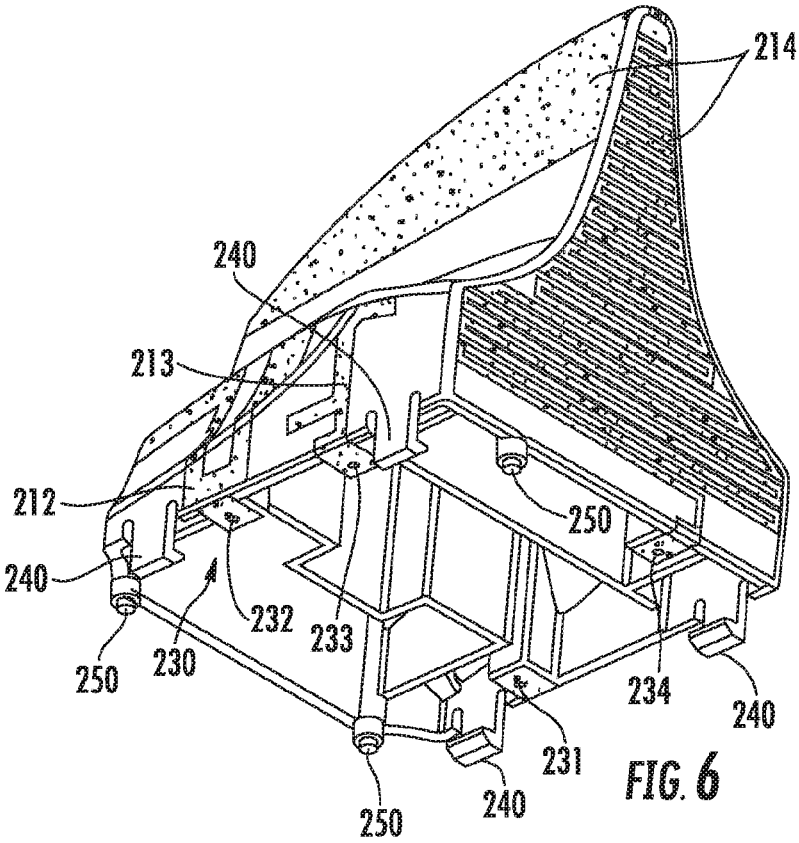
FIG. 6 is a bottom view of FIG. 2.

FIG. 2 is a perspective view depicting an embodiment of the housing of the external antenna for vehicle use; FIG. 3 is a left-side view of FIG. 2; FIG. 4 is a right-side view of FIG. 2; FIG. 5 is a rear view of FIG. 2, FIG. 6 is a bottom view of FIG. 2.

As illustrated in FIGS. 2 through 6, the antenna housing 200 according to an embodiment of this disclosure is furnished with a plurality of antenna radiating bodies 210 that send and receive signals in a plurality of frequency bands. The radiating bodies 210 consist of a conductive material, for example metal.

The radiating bodies 210 may comprise a first through fourth radiating body 211, 212, 213, 214.

The first radiating body 211 is formed on one side of the housing 200 as a pattern, e.g. it may be formed as a belt on the left side as shown in the drawing, and may comprise an LTE main antenna that realizes a main band within the LTE frequency band.

The second radiating body 212 is formed as a pattern on the opposite side of the housing 200 from where the first radiating body 211, e.g. it may be formed as a belt on the right side as shown in the drawing, and may comprise an LTE diversity antenna that realizes a diversity band within the LTE frequency band.

The first radiating body 211 and second radiating body 212 in this embodiment have been illustrated as an LTE frequency antenna configuration; however, they are not limited thereto, and the first radiating body 211 and second radiating body 212 may also be configured as antennas for the GSM or CDMA frequency band.

In addition, the first radiating body 211 and second radiating body 212 each comprise a high band 211*a*, 212*a* and a low band 211*b*, 212*b*. Here, in particular, in order to minimize signal interference in the low-frequency band, the length of the low band 211*b*, 212*b* should preferably be greater than the length of the high band 211*a*, 212*a*.

The third radiating body 213 may comprise a WiFi antenna that realizes a WiFi frequency band, formed as a pattern on one side of the same surface on which the first radiating body 211 or second radiating body 212 is formed, e.g. as in the drawing, it may be formed in the shape of a belt on the right side of the second radiating body 212. In this embodiment, the third radiating body 213 has been illustrated as a WiFi frequency antenna configuration; however, it is not limited thereto, and the third radiating body 213 may also be configured as an antenna for the Bluetooth frequency band.

The fourth radiating body 214 may comprise an AM/FM antenna formed on the back and top surface of the housing 200 so as to realize the AM/FM frequency band.

Accordingly, because radiating bodies 211, 212, 213, 214 are realized for a plurality of frequency bands within a single housing 200, the difficulty of having to design the antenna radiating bodies 211, 212, 213, 214 separately and assemble them within a respective shark fin may be reduced, and fabrication costs may also be reduced by improving the inefficiencies in the use of space that arise when each antenna is mounted separately; by thus simplifying the assembly process, an overall reduction in cost may be obtained.

In addition, on the lower surface of the housing 200, a plurality of contact parts 230 are formed, connected to the respective radiating bodies 210. For example, there may be respectively installed on the edge of the bottom surface of the housing: a first contact part 231 connected to a first radiating body 211, a second contact part 212 connected to a second radiating body 232, a third contact part 213 connected to a third radiating body 233, and a fourth contact part 214 connected to a fourth radiating body 234.

In addition, on the lower surface of the housing 200, a plurality of hook parts 240 are formed on either side of the lower surface of the housing 200 so as to detachably couple the housing 200 to the circuit board 300.

Figure 7:
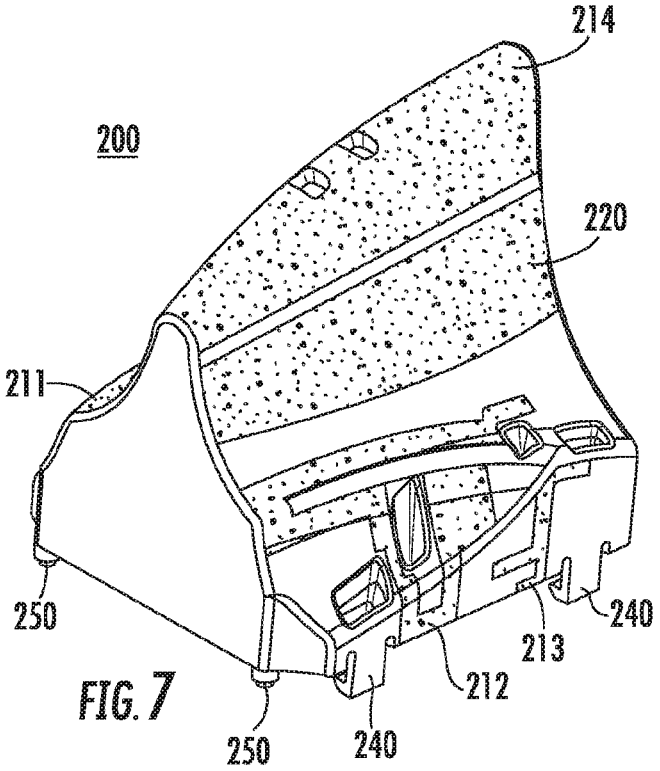
FIG. 7 is a perspective view depicting another embodiment of the housing of the external antenna for vehicle use.
Figure 8:
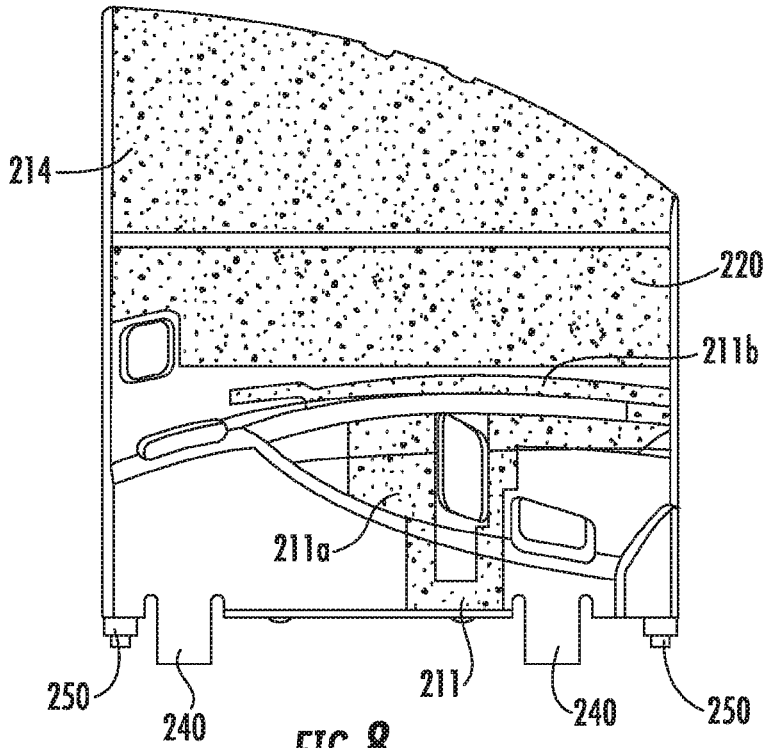
FIG. 8 is a left-side view of FIG. 7.
Figure 9:
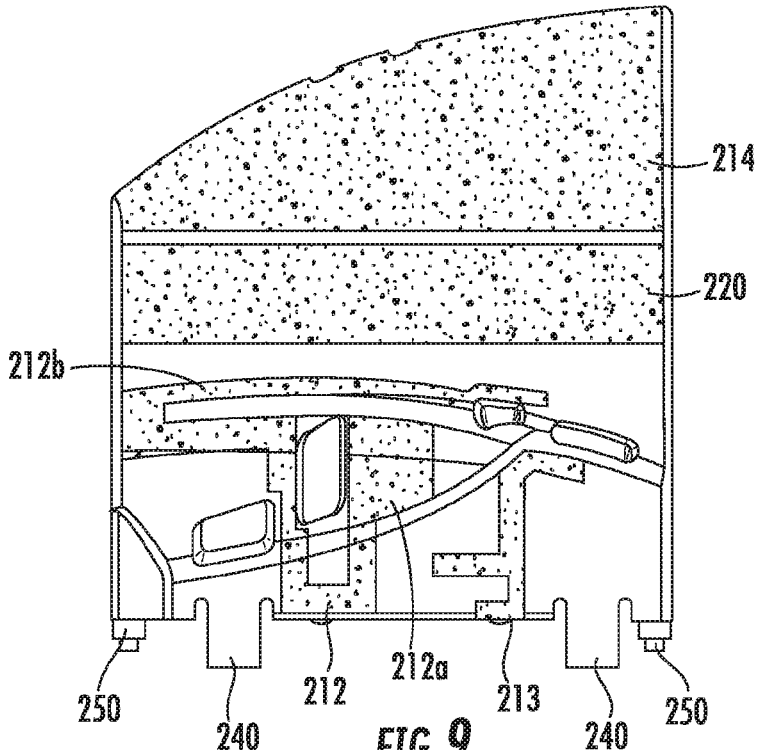
FIG. 9 is a right-side view of FIG. 7.
Figure 10:
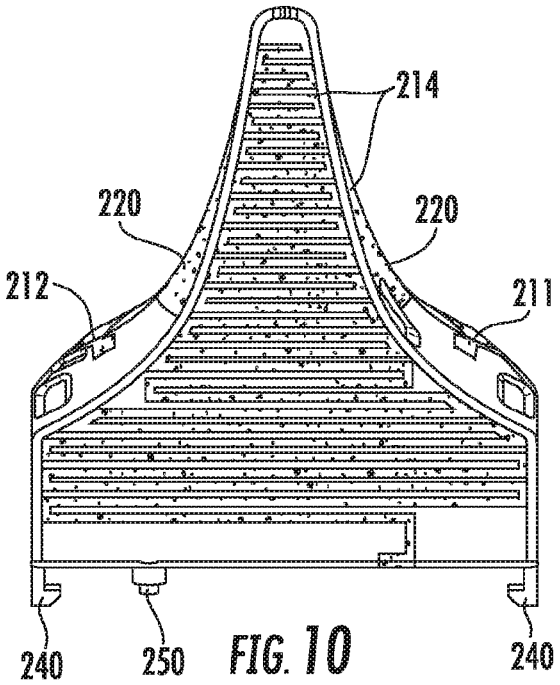
FIG. 10 is a rear view of FIG. 7.

FIG. 7 is a perspective view depicting another embodiment of the housing of the external antenna for vehicle use; FIG. 8 is a left-side view of FIG. 7; FIG. 9 is a right-side view of FIG. 7; FIG. 10 is a rear view of FIG. 7.

As shown in FIGS. 7 through 10, the antenna housing 200 according to a different embodiment of this disclosure may be furnished with a coupling patch 220 that increases the frequency bandwidth while reducing interference among the plurality of antenna radiating bodies 210 that send and receive signals in a plurality of frequency bands.

In this embodiment, the radiating bodies 210 comprise a first through fourth radiating body 211, 212, 213, 214; they are identical to the above embodiment described with reference to FIGS. 2 through 6. Accordingly, hereinbelow, only the coupling patch 220, which differs from the above embodiment, will be described in detail, while omitting the detailed description of the configuration elements and first through fourth radiating bodies 211, 212, 213, 214 that perform the same function as in the above embodiment.

The coupling patch 220 consists of a conductive material, for example metal.

The coupling patch 220 is formed on the outer surface of the housing 200, between the first radiating body 211, which is the LTE main antenna, and the second radiating body 212, which is the LTE diversity antenna. The coupling patch 220 in this embodiment has been illustrated as being formed on the outer surface of the housing 200; however, it is not limited to this configuration, and the coupling patch 220 may also be formed on the inner surface of the housing 200.

In addition, the coupling patch 220 may be formed on one side of the housing 200, between the first radiating body 211 and third radiating body 213 on one side of the housing 200; and may also be formed on the other side of the housing, between the second radiating body 212 and third radiating body 213. By this means, the coupling patch 220 may redundantly couple the first radiating body 211 and third radiating body 213, so as to simultaneously increase the frequency bandwidth of the first radiating body 211 and third radiating body 213. Additionally, the coupling patch 220 may redundantly couple the second radiating body 212 and third radiating body 213, so as to simultaneously increase the frequency bandwidth of the second radiating body 212 and third radiating body 213.

In addition, because the low bands 211*b*, 212*b* of the first radiating body 211, which is the LTE main antenna, and the second radiating body 212, which is the LTE diversity antenna, are formed adjacent to the coupling patch 220, signal interference in the low-frequency band may be minimized, and frequency bandwidth may be increased.

In this embodiment, the coupling patch 220 has been illustrated as a pattern formed in an approximately quadrilateral shape; however, it is not limited thereto, and although not shown in the drawings, it may also be formed as a pattern in diverse other shapes, such as screw or zig-zag shapes.

Accordingly, because the coupling patch 220 is used to find an optimal location for mutual interference between the antennas for a plurality of frequency bands, it enables improvement in transmission speed without data distortion by minimizing signal interference between the antennas covering a plurality of frequency bands within a narrow space, particularly the LTE main antenna 211 and the diversity antenna 212; and also enables maximizing the antenna radiation efficiency and increasing the antenna frequency bandwidth.

Figure 11:
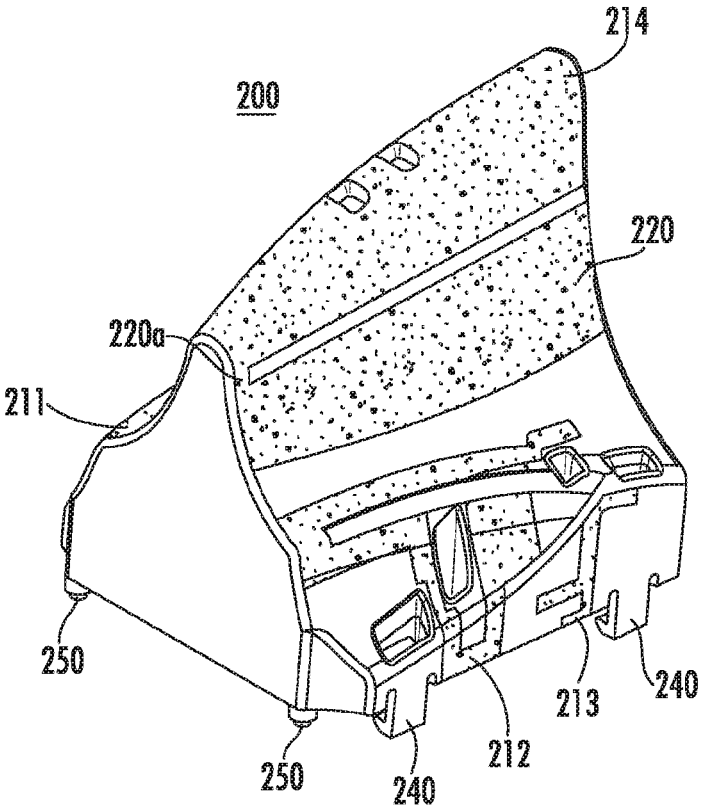
FIG. 11 is a perspective view depicting another embodiment of the housing of the external antenna for vehicle use.

FIG. 11 is a perspective view depicting another embodiment of the housing of the external antenna for vehicle use.

As shown in FIG. 11, the antenna housing 200 according to a further embodiment of this disclosure is furnished with a coupling patch 220 that increases the frequency bandwidth while reducing interference between the plurality of antenna radiating bodies 210 that send and receive signals in a plurality of frequency bands.

In this embodiment, one portion of the coupling patch 220 may be formed so as to connect to the antenna radiating body 210 of a different frequency band. For example, the coupling patch 220 may be formed to connect 220*a* as a single unit with the fourth radiating body 214 which is formed as a pattern on the top of the housing 200 and realizes the AM/FM frequency band.

Accordingly AM/FM is expanded to the area of the existing AM/FM radiating body 214 and the coupling patch 220, so as to increase the AM/FM bandwidth, and for LTE, the area of the coupling patch 220 serves as a coupling patch between the LTE main antenna 211 and diversity antenna 212 so as to minimize signal interference and increase bandwidth.

Figure 12:
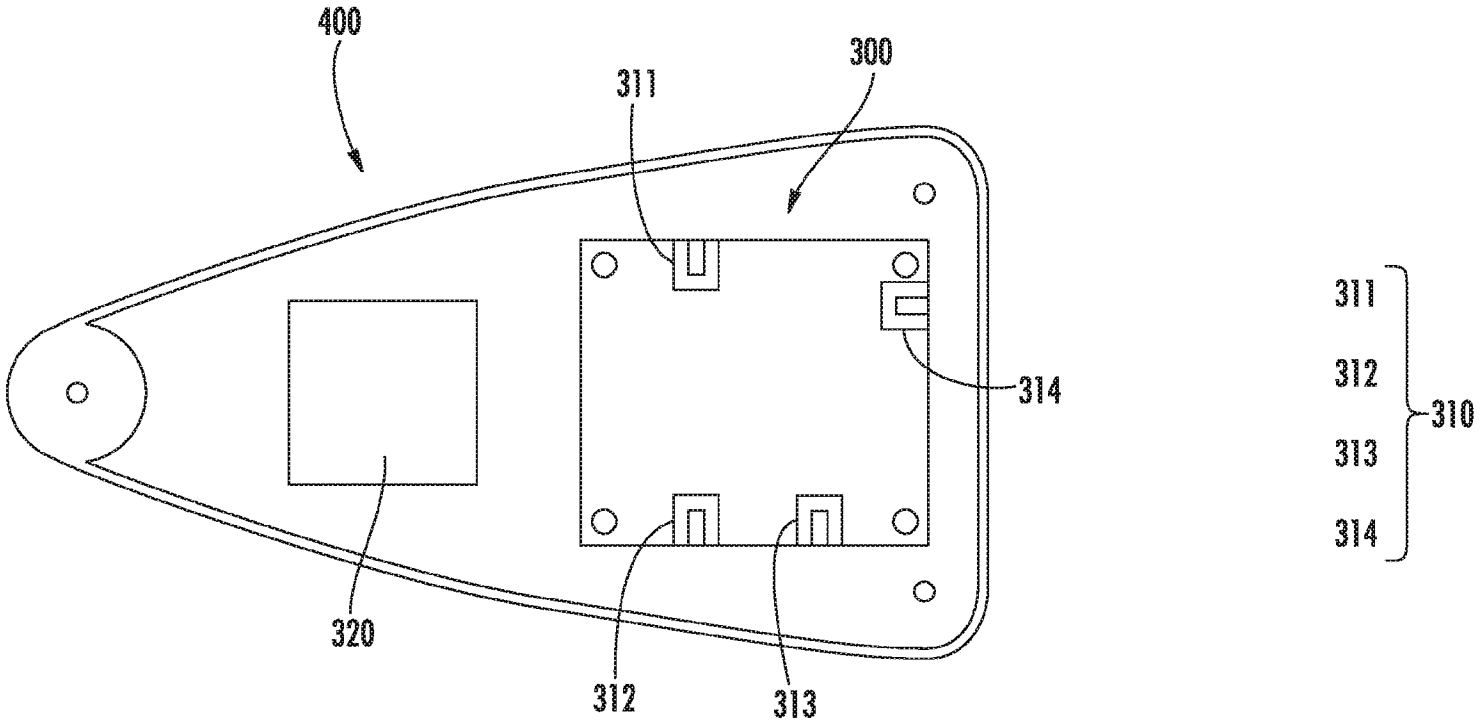
FIG. 12 is a plan view depicting the circuit board and base of the external antenna for vehicle use.

FIG. 12 is a plan view depicting the circuit board and base of the external antenna for vehicle use.

As shown in FIG. 12, the circuit board 300 is installed affixed to the base 400. On the circuit board 300, a plurality of feeding pads 310 are formed, electrically connected to the radiating bodies 210 of the housing 200. For example, there may be respectively installed on the top surface of the circuit board 300: a first feeding pad 311 electrically connected to the first contact part 231 of the first radiating body 211, a second feeding pad 312 electrically connected to the second contact part 212 of the second radiating body 232, a third feeding pad 313 electrically connected to the third contact part 213 of the third radiating body 233, and a fourth feeding pad 314 electrically connected to the fourth contact part 214 of the fourth radiating body 234.

In addition, on the circuit board 300, there may be mounted at least one or more matching circuits 320 to modulate the first radiating body 211, which is the LTE main antenna, and the second radiating body 212, which is the LTE diversity antenna, to a desired frequency. The matching circuits 320 may be configured so as to cover one or more of the frequency bands 2G (GSM850, GSM900, DCS, PCS, CDMA, US-PCS), 3G (WCDMA850/900/1800/1900/2100) and 4G (LTE). Because these matching circuits 320 are understandable as a well-known technology, their detailed description is omitted.

Additionally, in the circuit board 300, there may be mounted one or more variable capacitors to modulate the frequency of the antennas. The variable capacitors may optionally be configured as a plurality of fixed capacitors having switches, a varactor, or a MEMS capacitor. Because these variable capacitors are understandable as a well-known technology, their detailed description is omitted.

Figure 13:
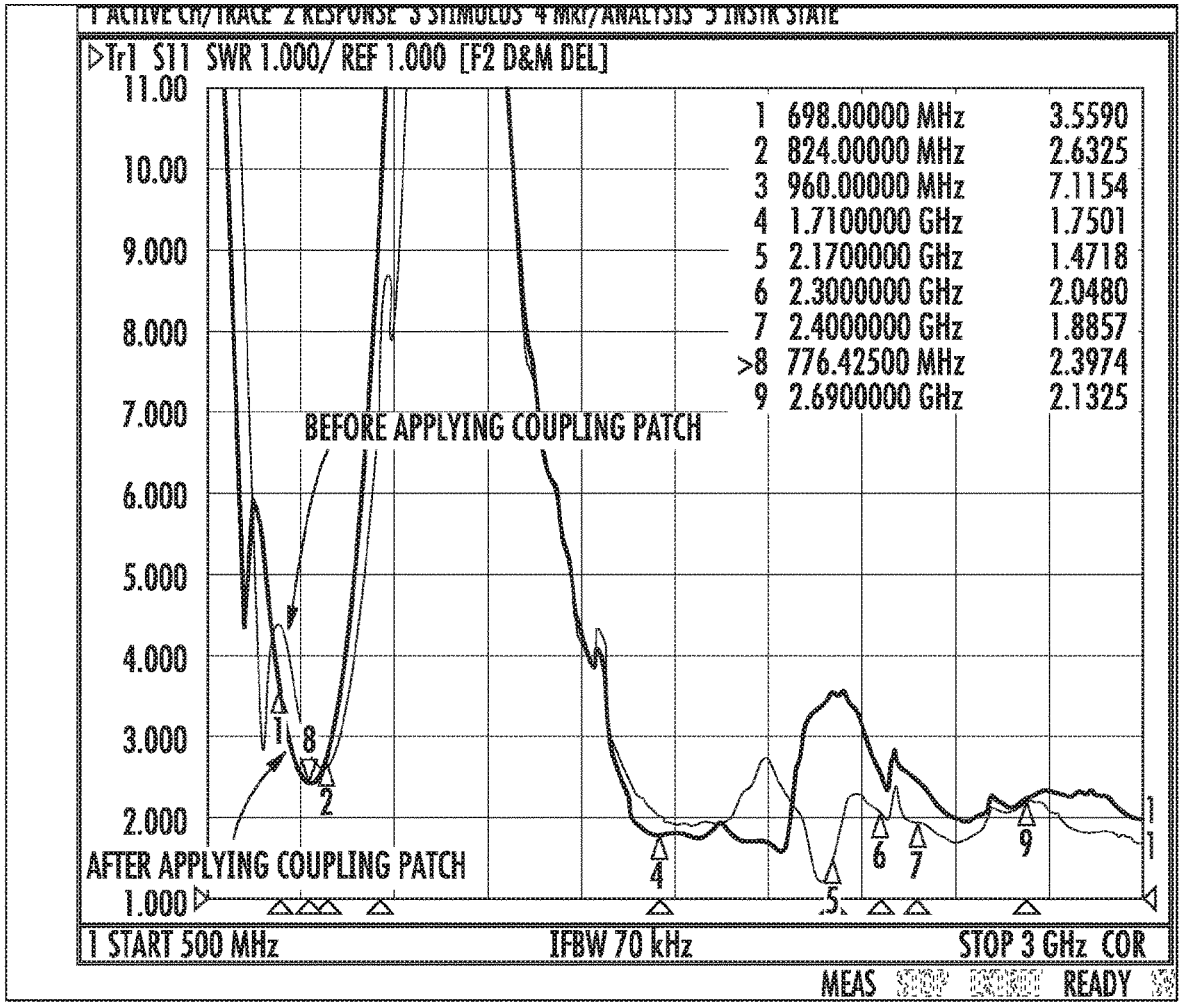
FIG. 13 shows experimental results demonstrating the standing wave ratio of the before and after applying the coupling patch for each LTE frequency band of the external antenna for vehicle use of this disclosure.

FIG. 13 shows experimental results demonstrating the standing wave ratio (SWR) of the before and after applying the coupling patch for each LTE frequency band of the external antenna for vehicle use of this disclosure.

Referring to FIG. 13, it is apparent that when the coupling patch 220 is used, the frequency bandwidth is increased and loss reduced compared to the situation in which the coupling patch 220 is not used, in the 698 MHz to 960 MHz band, 1710 MHz to 2170 MHz band, and 2300 MHz to 2690 MHz band.

Table 1 below shows the antenna radiation efficiency before and after applying the coupling patch.

TABLE 1

| | Frequency (MHz) | Gain value (peak) No coupling patch | Units: dBi Using coupling patch |
|---|---|---|---|
| NKI | 698 | −6.21 | −4.29 |
| NK2 | 824 | −1.12 | −0.08 |
| MK3 | 960 | −3.16 | −2.14 |
| NK4 | 1710 | 1.67 | 2.64 |
| MK5 | 2170 | 1.75 | 3.02 |
| NKB | 2300 | 2.07 | 2.77 |
| NK7 | 2400 | 2.18 | 2.93 |
| MK9 | 2690 | 3.08 | 3.73 |

As shown in Table 1, it is apparent that when the coupling patch 220 is used, the antenna gain increased compared to the situation in which the coupling patch 220 is not used, in the 698 MHz to 960 MHz band, 1710 MHz to 2170 MHz band, and 2300 MHz to 2690 MHz band.

Figure 14:
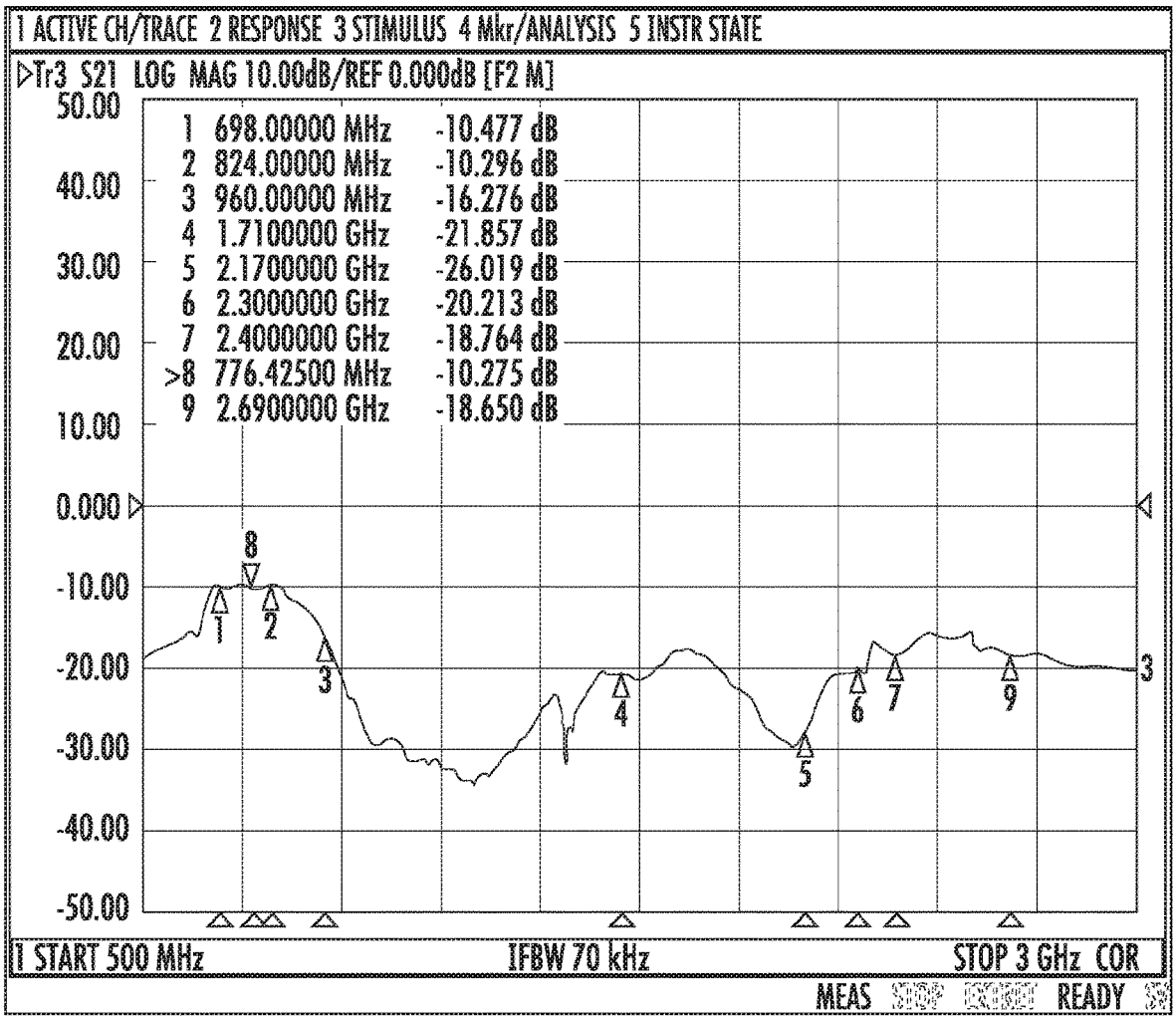
FIG. 14 shows experimental results demonstrating the signal interference after applying the coupling patch.

FIG. 14 shows experimental results demonstrating the signal interference after applying the coupling patch.

Referring to FIG. 14, the signal interference (isolation value) typically required in an LTE system is −8 dB or less throughout the entire band. This indicates that throughout the entire LTE band, data can be sent at high speed without distortion or deterioration in transmission speed.

In the external antenna for vehicle use according to this disclosure, power is fed to all radiating bodies 210 via the feeding pads 310 of the circuit board 300. Hereinbelow, for convenience of explanation, the feeding structure of the first radiating body 211 is described; because the feeding structures of the remaining second through fourth radiating bodies 212, 213, 214 are identical to that of the first radiating body 211, the detailed description thereof is omitted.

Figure 15:
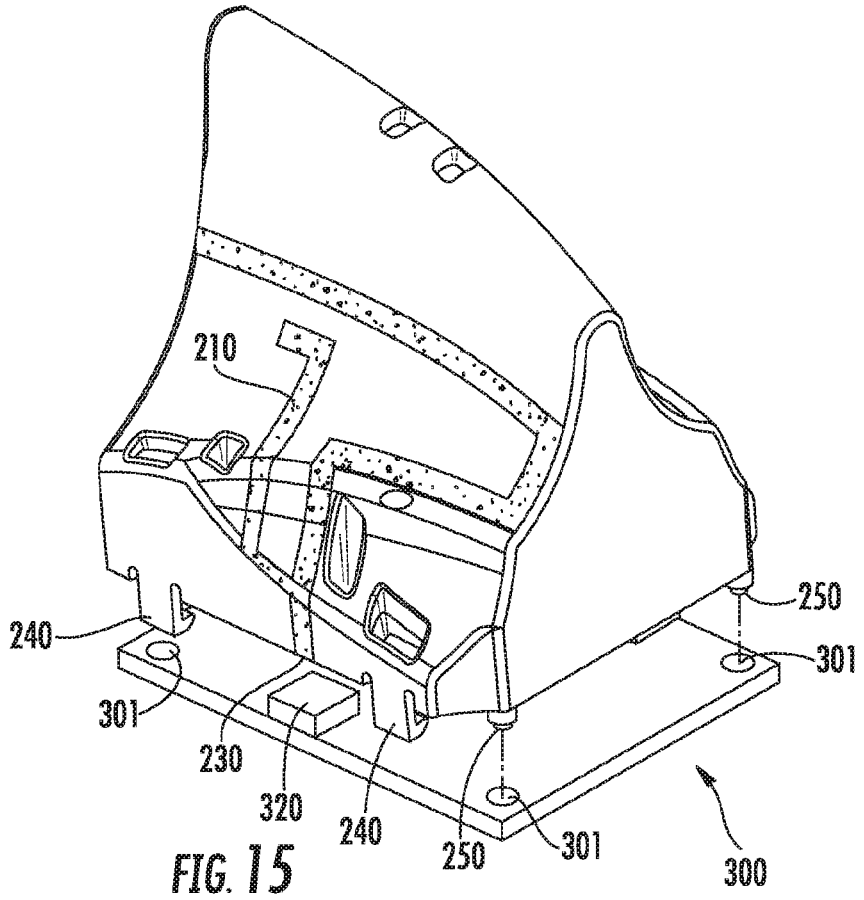
FIG. 15 is a perspective view showing an embodiment of the feeding structure of the external antenna for vehicle use of this disclosure.
Figure 16A:
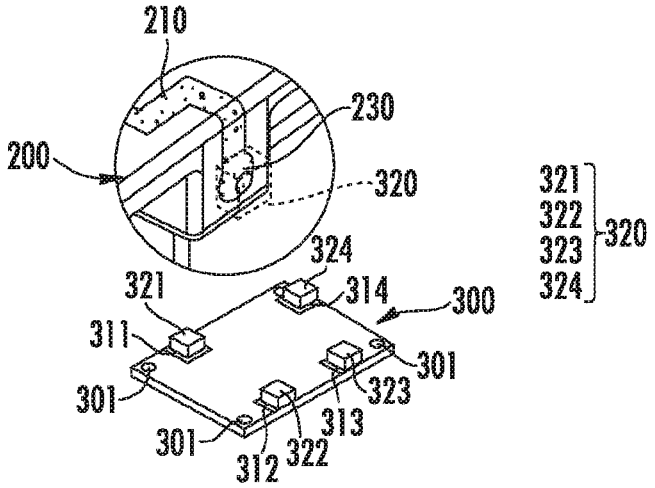
FIG. 16 is a detailed configuration diagram of portions A and B of FIG. 15.
Figure 16B:
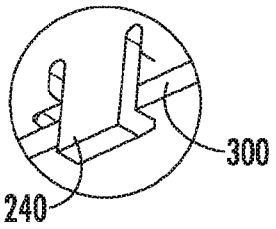

FIG. 15 is a perspective view showing an embodiment of the feeding structure of the external antenna for vehicle use of this disclosure; FIG. 16 is a detailed configuration diagram of portions A and B of FIG. 15.

As shown in FIGS. 15 and 16, on one side of the housing 200, a first radiating body 211, which is the LTE main antenna, is formed as a pattern. On the bottom of the housing 200, a first contact part 231 is furnished that connects to a first radiating body 211. In addition, on the top of the circuit board 300, a conductive first elastic part 321 is furnished that connects to a first feeding pad 311. In this embodiment, the elastic part may consist of a conductive foam 320. By this means, the first radiating body 211 may be elastically electrically connected to the first feeding pad 311 by contact between the first contact part 231 and first elastic part 321. In addition, although not shown in the drawings, the second radiating body 212, which is the LTE diversity antenna, is elastically connected to the second feeding pad 312 of the circuit board 300 by a second elastic part 322; the third radiating body 312, which is the WiFi antenna, is elastically connected to the third feeding pad 313 of the circuit board 300 by a third elastic part 323; and the fourth radiating body 214, which is AM/FM antenna, is elastically connected to the fourth feeding pad 314 of the circuit board 300 by a fourth elastic part 324 consisting of a conductive foam.

In this embodiment, the conductive elastic part 320 has been illustrated as being formed as a square shape, but it is not limited thereto, and may be formed in various other shapes such as a circle or ellipse.

On the bottom of the housing 200, a plurality of projecting parts 250 are formed to respectively fit into the recessed parts 301 formed on the circuit board 300. Additionally, on the bottom of either side of the housing 200, a hook part 240 is respectively formed to catch on the respective side of the circuit board 300. Accordingly, using the projecting part 250 and hook part 240, the housing 200 can be simply detachably coupled to the circuit board 300.

Figure 17:
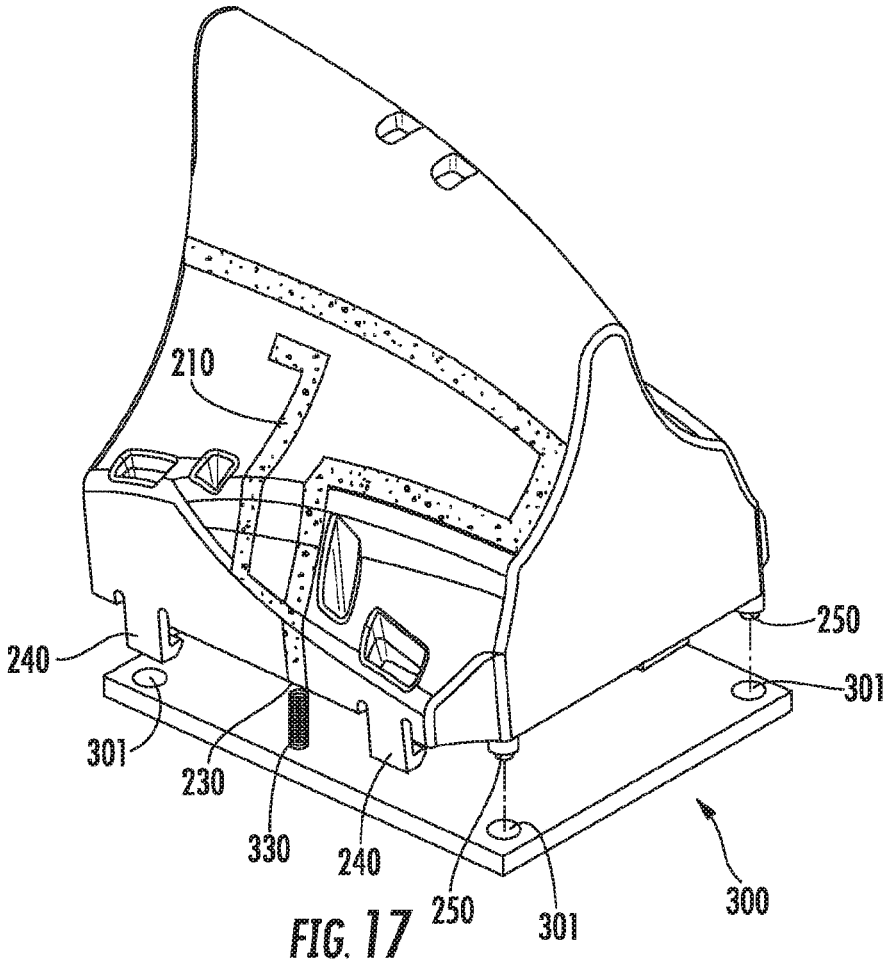
FIG. 17 is a perspective view showing another embodiment of the feeding structure of the external antenna for vehicle use of this disclosure.
Figure 18:
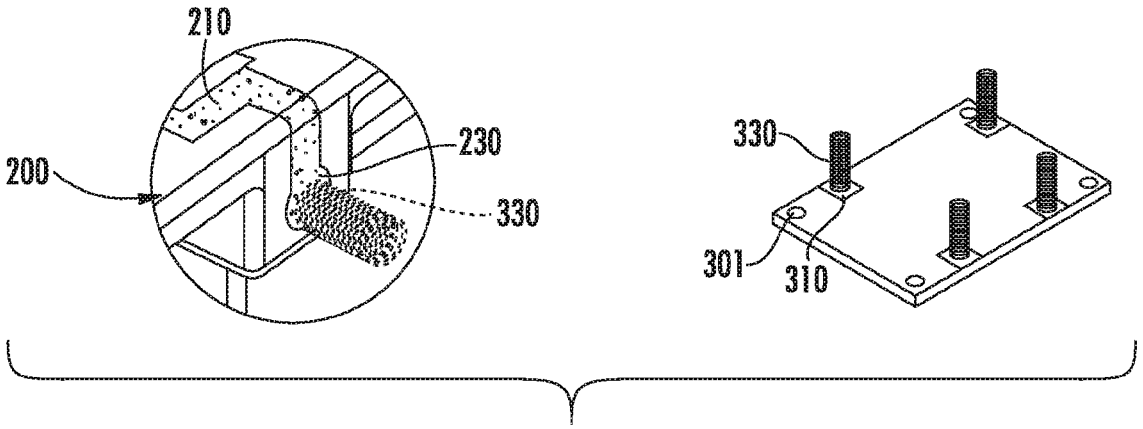
FIG. 18 is a detailed configuration drawing of portion C in FIG. 17.

FIG. 17 is a perspective view showing another embodiment of the feeding structure of the external antenna for vehicle use of this disclosure; FIG. 18 is a detailed configuration drawing of portion C in FIG. 17.

As shown in FIGS. 17 and 18, in this embodiment the elastic part may consist of a conductive coil 330. By this means, the radiating body 210 may be elastically electrically connected to the feeding pad 310 by mutual contact of the contact part 230 and the conductive coil 330.

Accordingly, because the radiating bodies 210 for the plurality of frequency bands are connected elastically to the feeding pad 310 by a conductive foam 320 or conductive coil 330, a power supply can be provided that is resilient against physical impact.

Hereinabove, embodiments of this disclosure were described with reference to the attached drawings, but a person of ordinary skill in the art to which this disclosure pertains will be able to understand that this disclosure can be implemented in different specific forms without altering the necessary characteristics or technical idea thereof. Therefore, the embodiments described hereinabove must be understood as exemplary, rather than limiting, in all respects. The scope of this disclosure is set forth in the claims below rather than in the detailed description; all alterations or altered forms derived from the meaning, scope and equivalents of the claims must be considered to be included within the scope of this disclosure.

The invention claimed is:

1. An external antenna for vehicle use, the external antenna comprising:

a case open at a bottom thereof, a housing inserted within the case and formed in a shape corresponding to an interior surface of the case, and furnished with a plurality of antenna radiating bodies that send and receive signals in a plurality of frequency bands, as well as coupling patches that increase the frequency bandwidth while reducing signal interference among the radiating bodies;

a circuit board mounted in the case and furnished with feeding pads that transmit electricity to the radiating bodies; and a base, whereon the circuit board is mounted, that couples to the case and blocks the open bottom of the case;

wherein the radiating bodies include a first radiating body that is formed as a pattern on one side of the housing and realizes a main band in the LTE frequency band and a second radiating body that is formed as a pattern on the other side of the housing opposite the side on which the first radiating body is formed, and realizes a diversity band in the LTE frequency range, wherein one of the coupling patches is formed on the inner surface of the housing between the first radiating body and the second radiating body.

2. The external antenna as defined as claim 1, wherein the first radiating body and the second radiating body comprise a frequency high band and a low band; and wherein the low band is formed so as to adjoin the coupling patch.

3. The external antenna as defined in claim 1, wherein the coupling patches are formed so as to connect to at least one of the plurality of radiating bodies formed as a pattern on the housing.

4. The external antenna as defined in claim 1, furnished with a contact part on the bottom of the housing, connected to the radiating bodies, and also furnished with a conductive elastic part on the top of the circuit board, connected to the feeding pads; and wherein the radiating bodies are electrically connected to the feeding pads by mutual contact of the contact part with the elastic part.

5. The external antenna as defined in claim 4, wherein the elastic part is a conductive foam or coil.

6. The external antenna as defined in claim 5, wherein a projecting part is formed on the bottom of the housing so as to fit into a recessed part on the circuit board, and a hook part is formed on the bottom of either side of the housing so as to catch onto either edge of the circuit board; and wherein the housing is fixed to the circuit board by the projecting part and the hook part.

* * * * *